United States Patent [19]

Kamath et al.

[11] 4,221,378

[45] Sep. 9, 1980

[54] COPY STACKING TRAY WITH RESTRAINING FINGERS

[75] Inventors: Venkatesh H. Kamath, Fairport; Michael A. Malachowski, Webster; Charles P. Vorndran, Rochester, all of N.Y.

[73] Assignee: Xerox Corporation, Stamford, Conn.

[21] Appl. No.: 35,880

[22] Filed: May 3, 1979

[51] Int. Cl.[3] ..... B65H 31/26

[52] U.S. Cl. ..... 271/220

[58] Field of Search ..... 271/220, 207, 208, 209, 271/223, 224

[56] References Cited

U.S. PATENT DOCUMENTS

| | | | |
|---|---|---|---|
| 1,086,353 | 2/1914 | Dick | 271/220 |
| 3,154,356 | 10/1964 | Lewis . | |
| 3,617,053 | 11/1971 | Menard . | |
| 3,774,790 | 7/1973 | Hoffman . | |
| 3,847,388 | 11/1974 | Lynch | 271/220 X |
| 4,056,264 | 11/1977 | Phooge . | |
| 4,111,410 | 9/1978 | Tates . | |
| 4,116,429 | 9/1978 | Van Buskirk . | |
| 4,124,204 | 11/1978 | Van Buskirk . | |
| 4,135,805 | 1/1979 | Taylor . | |

FOREIGN PATENT DOCUMENTS 2022563 5/1973 Fed. Rep. of Germany .

OTHER PUBLICATIONS

IBM Technical Disclosure Bulletin, vol. 7, No. 8, p. 714, Jan. 1965.

IBM Technical Disclosure Bulletin, vol. 15, No. 7, p. 2194, Dec. 1972.

*Primary Examiner*—Richard A. Schacher

[57] ABSTRACT

A copy receiving tray having a general vertical orientation and a bottom stop member and being pivotally mounted in a frame at the bottom of the tray and including means for decelerating and stacking sheets entering the tray comprising at least one resilient elongated member mounted above a sheet advancing means the free end of the decelerating member and the bottom stop member having mutually engageable fastening means whereby upon pivoting the tray the sheets stacked within the tray are restrained from falling out of the tray.

13 Claims, 8 Drawing Figures

COPY STACKING TRAY WITH RESTRAINING FINGERS

CROSS REFERENCE TO RELATED APPLICATION

Reference is made to copending application of V. Kamath and C. Vorndran Ser. No. 035,879 filed concurrently herewith entitled Copy Stacking Tray and to copending application of Donald W. Tates Ser. No. 035,372 filed concurrently herewith entitled Multimode Reproducing Apparatus. Both of the above identified copending applications are commonly assigned to the assignee of the present application.

BACKGROUND OF THE INVENTION

This invention relates to an output station for a reproducing apparatus and in praticular to a copy stacking tray of a multimode reproducing apparatus.

In the reproduction art it has frequently been found advantageous to be able to produce copies of original documents of varying size. For example, in addition to reproducing letter size 8½×11 inch originals and legal size 8½×14 inch originals it frequently is desirable to reproduce oversize original documents and particularly documents up to a size of 14×18 inches. While it has been desired to faithfully reproduce oversized original documents, it has also frequently been desired to be able to reduce in magnification an oversized original to a letter size copy.

While the desires of reproducing original documents have been many, so have the output capabilities also been many. It has of course been traditional to collect in an output tray multiple copies of regular or legal size documents. It has also been desired to be able to collect multiple pages of a multiple page document so that collated sets of the copied original documents are obtained.

PRIOR ART STATEMENT

When preparing faithful reproductions of normal or oversize originals or when preparing reduced magnification copies of normal or oversize originals the copies so produced have been collected in output tray.

Generally these copy output trays have been horizontally oriented relative to the copy output station so the copy sheet may fall directly into the tray. Alternatively if the tray is vertically oriented it normally only has the capability of stacking copy sheets of a single size, large or small. In addition, the use of horizontal stacking trays while generally satisfactory, increases the overall volume or working space required for the operation of the reproducing apparatus. To reduce this working space requirement, vertically inclined stacking trays have been proposed. While satisfactory in some respects two problems frequently arise. In stacking copy sheets of virtually any size difficulties are encountered by subsequent copies running into the trailing edge of the preceding copy and thereby being misdirected and perhaps falling out of the vertical tray. Trail edge restraining devices have been suggested to physically grip or hold the trailing edge of a copy sheet so that a subsequent sheet may pass over it. With the stacking tray arrangement described in U.S. patent application Ser. No. 035,879 filed concurrently herewith entitled Copy Stacking Tray copies are directed from the copy output transport of the reproducing apparatus to a vertically inclined external output stacking tray. In delivering copies to the stacking tray difficulties may be encountered in maintaining the copies stacked within the tray since upon hitting the bottom stop portion of the tray the copy sheets tend to bounce back and in some instances the stack may collapse. In addition, with the compact configuration described when the door of the sorter is opened for maintenance or clearance of paper jams the attached external tray is tipped over and the copies may fall out of the tray. In addition, oversize or large copies when fed to a vertical stacking tray may collapse when stacked or roll out of the tray.

Various reproducing apparatus are available on the market which are capable of collecting and sorting copies of reproduced originals. For example, the Xerox 3400 copier has the capability of reproducing single copies of an original document and collecting them in a single catch tray. With the aid of a document handler and a copy sorter this apparatus is also capable of making collated sets of multiple page original documents. For example, if five copies of a five page original document are desired, each page of the five page original is fed in order to the document handler, the five copies of each page are delivered, one each to the first five bins of the sorter. This is repeated for all five pages of the original document until complete collated sets of copies are produced in the individual sorter bins. While this machine can collect a large number of copies in a single tray or it can sort copies in the sorting bins, it is not possile to reproduce oversize documents. Nor is it possible to produce copies reduced in magnification from the original. For further details of this type of reproduccing apparatus reference is made to U.S. Pat. Nos. 4,111,410 to Tates et al.; 4,116,204 to Van Buskirk et al., 4,124,204 to Van Buskirk and to 4,135,805 to Taylor et al.

A further multimode reproducing machine commercially available is the Xerox 3107 which has an optical system including a second lens to enable a reduction mode of copying. In this machine, a document may be placed on the platen and a faithful reproduction made with the use of a scanning optical system in a first mode of operation. In a second mode of operation the optical assembly is locked into position at the edge of the platen and the document feeder feeds the document past the stationary optical system. In this mode oversized documents may be faithfully reproduced. In a third mode of operation a second lens is moved from a stored position to an operative position and is used to project an image of the document onto the imaging surface at a magnification different from the first magnification. U.S. Pat. No. 4,053,221 to Lynch is illustrative of a machine similar in many respects to this machine.

In U.S. Pat. No. 3,744,790 to Hoffman a multimode copier is described which has a collecting tray for collecting single copies together with a sorter for use when the copier is used in a sorting mode to make multiple copies of multiple page originals. In addition, coupled within the sorter is a collecting tray to collect copies in surplus of the number of collecting trays in the sorter when used in the sorting mode of operation. Thus if there are fifteen horizontally arrayed vertical bins in the sorter and twenty copies are made, the first fifteen will fall into the individual bins and the last five will be collected in the surplus or overflow tray.

Vertically oriented copy catch trays are known in the art. U.S. Pat. No. 3,154,356 to Lewis et al. discloses a catch tray for receiving both documents and copies. U.S. Pat. No. 3,617,053 to Menard discloses a similar copy and original catch tray. U.S. Pat. No. 4,056,264 discloses a stack forming device with a vertically inclined stacking tray and rotatably driven traction surface to propell the sheet against the stacking tray. IBM Technical Disclosure Bulletin Vol. 15, No. 7, December 1972, Page 2194 discloses a copy output station where the copies are deflected by a flexible flap into an output tray. IBM Technical Disclosure Bulletin Vol. 7, No. 8, January 1965, Page 714 shows a document stacker wherein documents of a wide range of sizes are stacked by being propelled against a resilient end plate while being deflected down. The documents are fed under a beveled brush which has a low friction force resisting entry of documents and a high friction force resisting the rebound of documents. German Patent No. 2,022,563 shows a similar type of braking brush bundles. U.S. Pat. No. 4,056,264 to Dhooge et al. is exemplary in showing the use of metal guides or bail bars in stack forming devices.

SUMMARY OF THE INVENTION

In accordance with this invention a copy catch tray for stacking sheets is provided.

More particularly, the present invention is directed to apparatus for stacking sheets comprising a frame, a vertical stacking tray pivotally mounted at its bottom to the frame, the tray having a stop portion at its bottom and means for decelerating and stacking sheets as they enter the tray comprising at least one resilient elongated member mounted above the tray having a free end at the bottom of the tray, the elongated member and the bottom stop portion of the tray having mutually engagable fastening means whereby upon pivoting the tray to an open position the fastening means of the elongated member and the stop portion are engaged and restrain sheets already stacked within the tray from falling out of the tray.

The present invention also provides a vertically inclined stacking tray for a multimode reproducing apparatus which takes up very little additional space.

Accordingly, it is an object of the present invention to provide a novel copy receiving tray for stacking sheets.

It is an additional object of the invention to provide a compact vertical stacking tray from which stacked sheets will not fall out of when the tray is pivoted to an open position.

It is a further object of the invention to provide a compact downhill stacking tray in which sheets are deflected and decelerated while entering the stacking tray.

For a better understanding of the invention as well as other objects and further features thereof reference is had to the following drawings and description.

DESCRIPTION OF PREFERRED EMBODIMENT

The invention will now be described by reference to a preferred embodiment of the reproducing apparatus output station with copy stacking tray.

Figure 1:
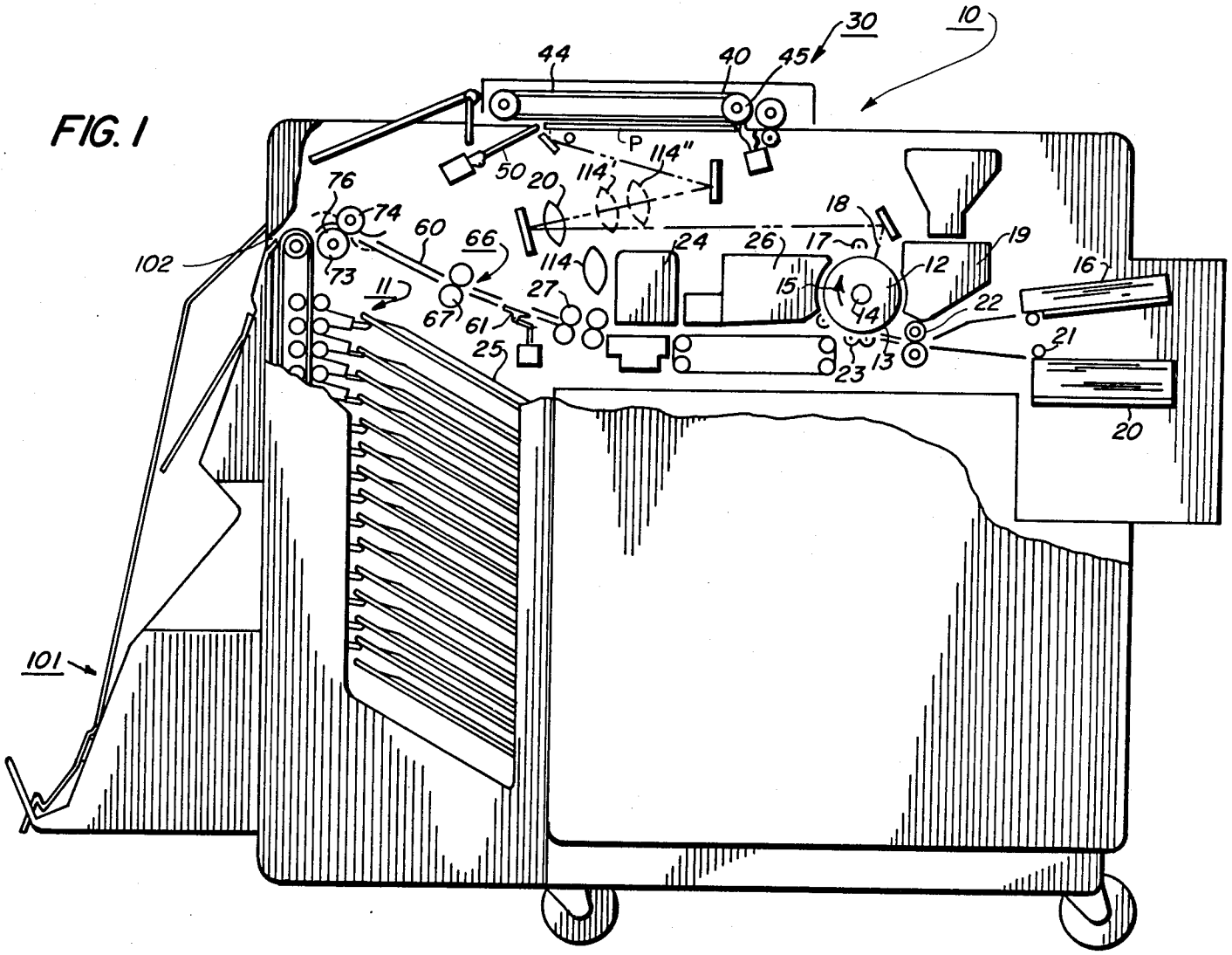
FIG. 1 is a schematic representation of an automatic xerographic reproducing apparatus employing the copy catch tray and restraining fingers of the present invention.

Referring now to FIG. 1, there is shown by way of example an automatic xerographic reproducing machine 10 which includes the copy output station 11 of the present invention. The reproducing machine 10 depicted in FIG. 1 illustrates the various components utilized therein for producing copies from an original. Although the apparatus 11 of the present invention are particularly well adapted for use in an automatic xerographic reproducing machine 10, it should become evident from the following description that they are equally well suited for use in a wide variety of processing systems including other electrostatographic systems and they are not necessarily limited in their application to the particular embodiment or embodiments shown herein.

The reproducing machine 10 illustrated in FIG. 1 employes an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, and *Xerography and Related Processes* by Dessauer and Clark, both published in 1965 by the Focal Press.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 wherein the charged photoconductive surface 13 is exposed to a light image of the original input scene information whereby the charge is selectively dissipated in the light exposed regions to record the original input scene in the form of an electrostatic latent image. A suitable exposure system may be of a type described in U.S. Pat. No. 3,832,057, issued to Shogren in 1974. After exposure drum 12 rotates the electrostatic latent image recorded on the photoconductive surface 13 to development station 19 wherein a conventional developer mix is applied to the photoconductive surface 13 of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as for example by the use of a cleaning blade.

The apparatus is also equipt with a document handler 30 including a platen belt transport 40 wrapped about two pulleys 44 and 45 to transport documents across the platen P to registration gate 50. During the imaging cycle the registration gate 50 is retracted. After imaging the document is advanced off the platen by the belt transport Further details of a document handler similar in many respects may be had by reference to U.S. Pat. No. 4,155,805 to Taylor et al.

Still referring to FIG. 1 the copy output station 11 is arranged adjacent the output of the xerographic processor. As sheet 16 exits from the fuser 24, it is carried by the processor output rolls 27 along the horizontal sorter transport 60 in a general horizontal orientation. A deflection gate or pivoting chute 61 is arranged to selectively deflect the sheet 16 from the horizontal sorter transport 60 into the output tray 25 or to allow its continued advancement along the horizontal transport. When the chute 61 is in its up position as shown in solid lines in FIG. 2, the sheet 16 exits from the output rolls 27 and falls into the output tray 25 which is inclined downwardly toward the processor 10. When the chute is in its down position as shown in phantom in FIG. 2, the sheet 16 is directed forward along the horizontal sorter transport 60. The deflection chute 61 is actuated by means of a solenoid 65.

Driven pinch rollers 66 are arranged at an intermediate position along the horizontal sorter transport 60. These rollers are driven to advance the sheet at about the speed of the output rolls 27. The upper sheet guides 70 and 75 comprise wire forms which are pivotally supported in the main sorter frame.

As a sheet 16 proceeds further along the horizontal transport 60, it is fed into the nip formed by driven turn roll 73 and nip gate roll 74. With deflection gate 76 in the down position shown in solid line in FIG. 2, the sheet 16 is forced into the nip between turn roll 73 and belt drive roll 77. Upon exiting the nip the sheet 16 is guided onto the vertical transport 78 of the output station 11. The drive belts 79 are driven at high speed as compared to the horizontal transport rolls 60 so that upon the copy sheet being gripped in the nip between the turn roll 73 and the drive belts 79, it is pulled at a high speed from the nip of the horizontal transport rolls 60.

The vertical transport 78 is composed of a plurality of pinch roll sets 81. One set of pinch rolls may be arranged adjacent each of the bins 82 of the sorter 11. A plurality of spaced apart drive belts 79 are arranged across the width of the sorter from front to back. They are wrapped around belt support roll 77 and drive pulley 83 at the bottom of the vertical transport, so that this belt provides driving engagement with a sheet nipped between turn roll 73 and belt drive roll 77. The inner run 74 of the belts 79 runs through the nips of each of the pinch roll sets 81. The pinch rolls comprising the sets 81 are arranged to idle on their respective shafts 84. The drive belts 79 provide the driving engagement with the sheet 16 as it is carried along the vertical transport 78. The inner-pinch rolls 85 are supported in the main sorter frame. The outer pinch rolls 86 are supported in a frame assembly or door 90 which is arranged to pivot away from the main sorter frame in order to allow access to the vertical transport 78 sheet path for jam clearance by the operator.

The vertical sorter bin array is composed of a plurality of sorting trays 87 arranged in a parallel fashion, one above the other, to provide a vertical row of bins 82. Each bin is defined by the sheet receiving tray 87.

Associated with the bins 82 are a series of deflection gates 91 each supported upon a shaft 93 journaled in the sorter frame 100. A plurality of deflection fingers 92 are supported in a spaced apart relationship along each shaft 93 to define the respective gates 91. The deflection fingers 92 are arranged to project between the respective pinch rolls 81 which are also spaced apart along their respective shafts 84. A stationary deflection chute 94 is used to guide a sheet 16 into the last bin 82B.

The compact bins are articulated such that their bin entrances can be selectively widened as a sheet is fed into them. This is accomplished by providing levers 95 secured at the ends of the deflection gate shafts 93, which operate against the bottom surface of the tray 87 defining the top of the respective bin 82 with which the shaft 93 is associated. The levers 95 selectively operate upon the trays 87 outside the sheet path to cam them upwardly in order to widen the bin entrance opening as a sheet is fed into the bin.

For further details of a similar sorter arrangement including the drive system and bin indexing, attention is directed to U.S. Pat. No. 4,116,429 wherein a similar apparatus is described.

Figure 3:
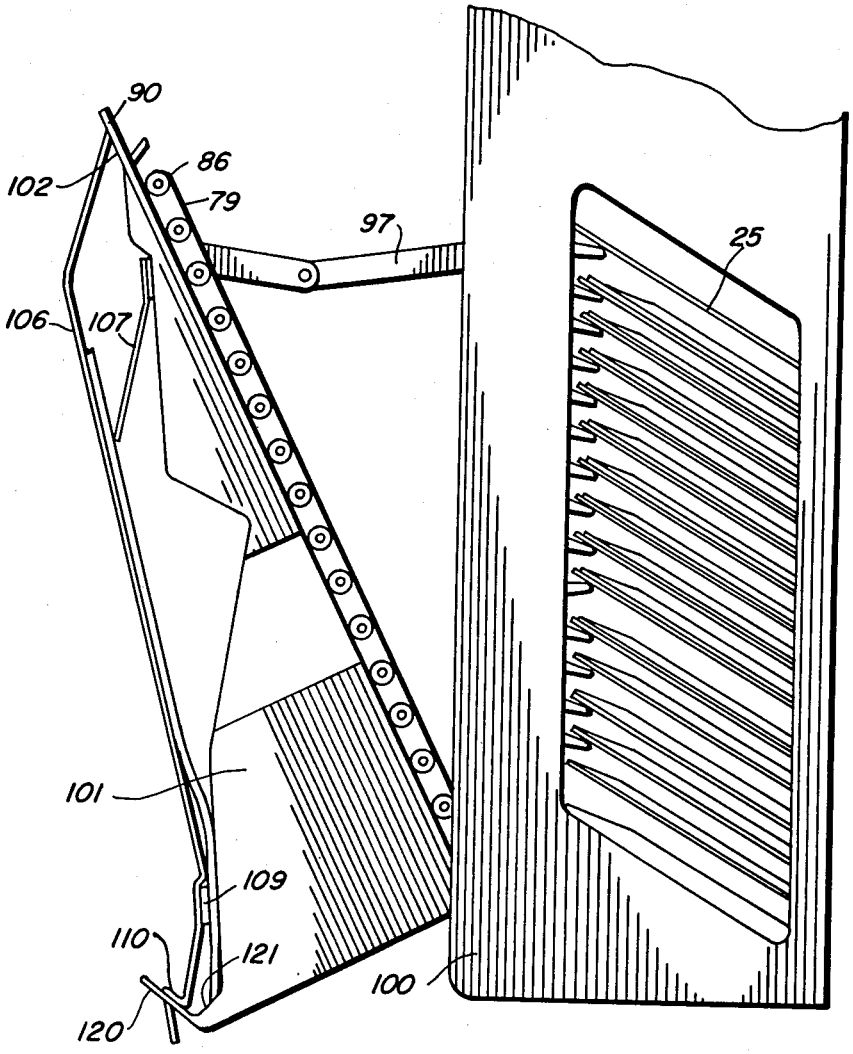
FIG. 3 is a side view of the copy output station with the sorter door open and depicting the stacking of copies in the external output tray.

Referring to FIG. 3, it is noted that the outer bank of vertical transport pinch rollers 86 and the drive belts 79 are arranged in a door-like frame assembly 90 which can be pivoted away from the main sorter frame assembly 100 which supports the inner pinch rollers 85 and deflection gates 91. The door 90 is arranged to pivot at the bottom about the input drive shaft, not shown, which thereby makes it unnecessary to disconnect the belt drives when the door is pivoted open. Folding links 97 are pivotally supported between the door and main sorter frame in order to prevent the door from falling completely open and for limiting the degree to which the door can be opened. A latch mechanism (not shown) is provided for holding the door 90 closed during normal operation.

The above described output station is capable of stacking multiple copies of single documents in tray 25 or of sorting multiple copies of multiple page original sets to produce collated sets. The size of the bins is such that oversized copies cannot be handled by either the output tray 25 or the sorter arrangement.

A second copy collecting tray positioned external of the sorter is provided to collect special copies. Copies are directed to this copy catch tray by moving deflection gate 76 to the up position as shown in phantom in FIG. 2. The activation of deflection gate 76 between directing sheets to the vertical array of sorting bins and the external output tray may also be controlled by a solenoid in much the same manner as with deflection gate 61. This second copy collecting tray permits the reproducing apparatus to be operated in a further and different mode of operation wherein oversized documents may be faithfully reproduced and collected in the external tray 101.

With the deflection gate 76 in the up position, the copy sheets are directed to the external output tray 101 rather than into the sorter bins. Output tray 101 enables the stacking of different size documents in the same tray. It also enables the stacking of copies with out subsequent sheets running into the trailing edges of previously stacked sheets. It particularly enables the stacking of large copies without collapsing the stack.

Figure 6:
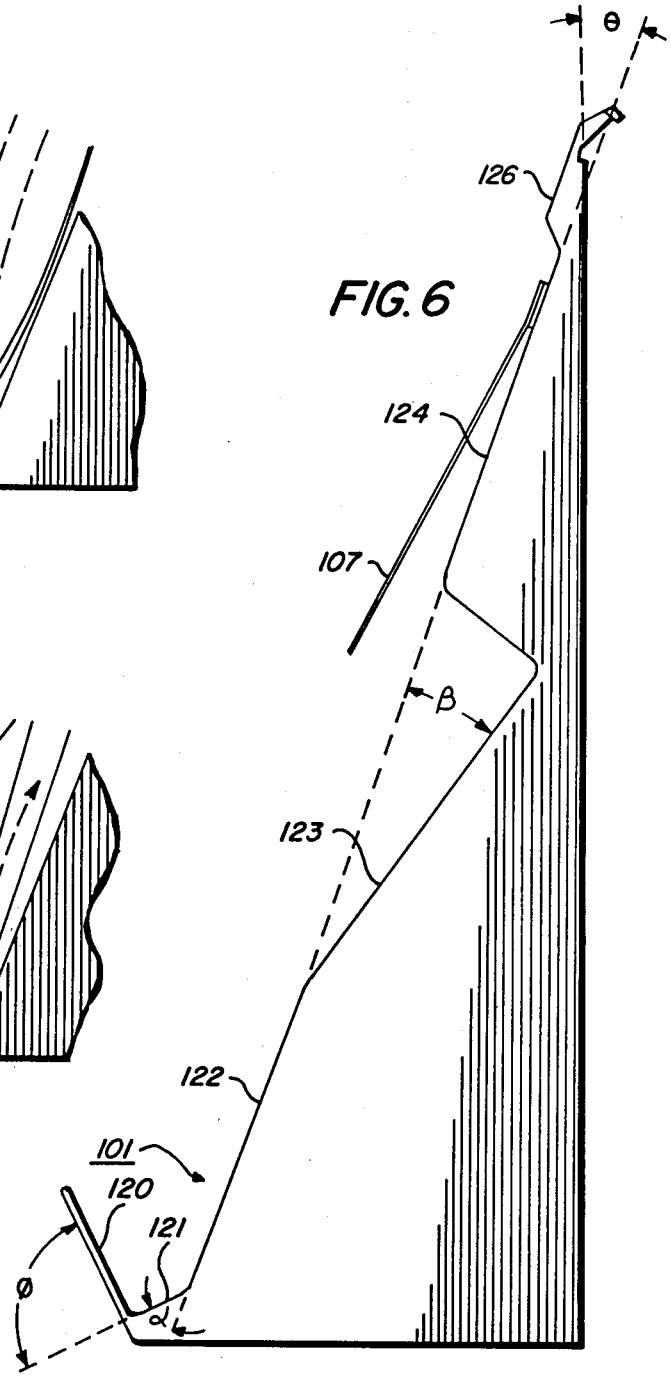
FIG. 6 is a side view of the external output tray showing the structural relationship in greater detail.

This is accomplished with vertically inclined tray 101 positioned opposite exit slot 102 of the reproducing apparatus. Attention is directed to FIG. 6 wherein the tray comprises a sheet stop member comprising a horizontally inclined stop portion 121 and an associated vertically inclined restraining lip 120. The main tray including portions 122 and 124 are vertically inclined at about the same angle and in the same plane so that an oversized copy may lie flat against first stacking portion 122 and third stacking portion 124. Second stacking portion 123 between first and third stacking portions is inclined further to the horizontal than first and third stacking portions. In addition, the first and second portions 122 and 123 are each equal to or slightly larger than one half the size of a first size of copy sheet. This relationship enables the sheet to be stacked against stacking portion 122 for approximately its lower half while the upper portion bends slightly and rests against the second stacking portion. This enables the successful stacking in the tray of subsequently stacked sheets without them running into the trailing edge of a previously fed sheet. In practice the combined size of stacking portions is slightly larger than letter or legal size copies to comfortably accommodate them within the tray 122 and 123. At the bottom of tray portion 122 is sheet stop member including a stop portion 121 to generally provide lead edge directional control of sheets being fed. This stop member also includes restraining lip 120 to contain the lead edge portion of the stacked sheets within the stop member.

For larger copy sheets up to a second size larger than a first size, the sheets are fed into the stacking tray, fall by gravity to the bottom with the bottom part of the sheet coming to rest on stacking portion 122 and the top portion on stacking portion 124. Large copy stacking member 126 insures that with the stacking of oversized copies the lead edge of subsequently fed sheets does not run into the trailing edge of previously fed sheets.

Stop portion 121 is dimensioned so that the smallest sheets up to a first maximum size when seated in the tray have a tendency to pivot toward portion 123 and at the same time is dimensioned so that for oversized they do not buckle.

The stacking tray is generally vertically oriented slightly inclined toward the horizontal in any suitable position. The greater the vertical orientation, the smaller will be the space taken up by the external stacking tray. However as will be appreciated by reference to FIG. 3 with a rather steeply oriented vertical tray, no additional space is required since the tray may be mounted on the back of the sorter door which has to be capable of being opened for jam clearance and maintenance. Since the sorter door pivots at the bottom and opens at the top, and the bulk of the volume of the vertically inclined stacking tray is at the bottom, no additional space is required. The tray is inclined from the vertical by an angle $\theta$ which typically is greater than about 20°. At angles less than 20° the tray is very steep increasing the probability that stacked sheets will buckle and fall out of the tray. At angles greater than 20° the tray becomes more horizontally orientated resulting in generally easier copy stacking. Thus the stacking portions 122 and 124 are horizontally inclined to the vertical by an angle greater than about 20°. With this orientation the second stacking member 123 is further inclined by an angle $\beta$ to the horizontal between stacking portions 122 and 124 to enable the shorter sized copy sheets to be readily stacked. Typically this inclination away from the path of sheet feeding is small but sufficiently large to enable the small copies to bend sufficiently with their top portions falling back out of the way of subsequently fed sheets. Preferably it is sufficiently large to enable the stacking of several copies of the smaller size paper. While the second stacking portion may be at any suitable angle an angle of at least 15° has been found particularly suitable in providing adequate bending, suitable stacking capacity and minimizing the lead edge diving of sheets.

Figure 7A:
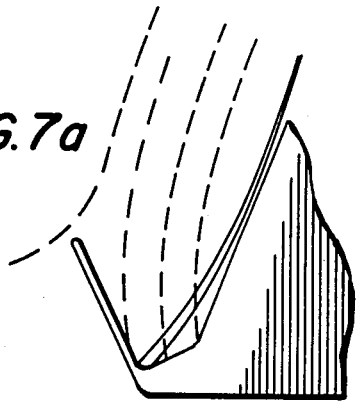
FIGS. 7A and 7B are enlarged partial side views of the lower portion of the external output tray showing several orientations of copy sheets in the tray for illustrative and comparative purposes.
Figure 7B:
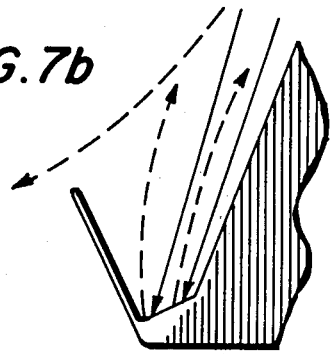

At the bottom of the external tray is a stop member including a stop portion 121 vertically inclined to the horizontal and inclined to the plane of the stacking tray by any suitable change of direction angle $\alpha$. Typically the change of direction angle $\alpha$ is from about 40° to about 50° in providing reliable stacking of the sheets. If the angle is less than 40° the paper changes direction, the propensity to buckle and for the lead edge to collapse increases as shown in the dotted lines of FIG. 7A. If the angle $\alpha$ is greater than 50° the copy sheets may tend to bounce back vertically and form a lead edge curl and collapse as shown in FIG. 7B. This is particularly true if the lip 120 is short. With a change of direction angle of from about 40° to about 50° these difficulties are minimized and the copy sheets are generally oriented as shown in solid lnes in FIG. 7A.

The retaining lip 120 is positioned to minimize the possibility of the end of a stacked copy sheet from riding up the edge and out of the stacking tray. If the angle $\phi$ is large the stacking capacity of the tray may be diminished and as it becomes small the stacked copy sheets may tend to ride up the restraining lip and fall out of the tray. Typically this angle is from about 90° to about 110° in providing a balance between satisfactory stacking capacity and retention capability.

According to the present invention upon exit of the copy sheet through slot 102, the copy sheet is deflected down by two deflection and restraining fingers 106 on either side of the tray into the bottom of the generally vertical inclined stacking tray 101. These fingers are positioned near each side of the external output tray 101.

Figure 2:
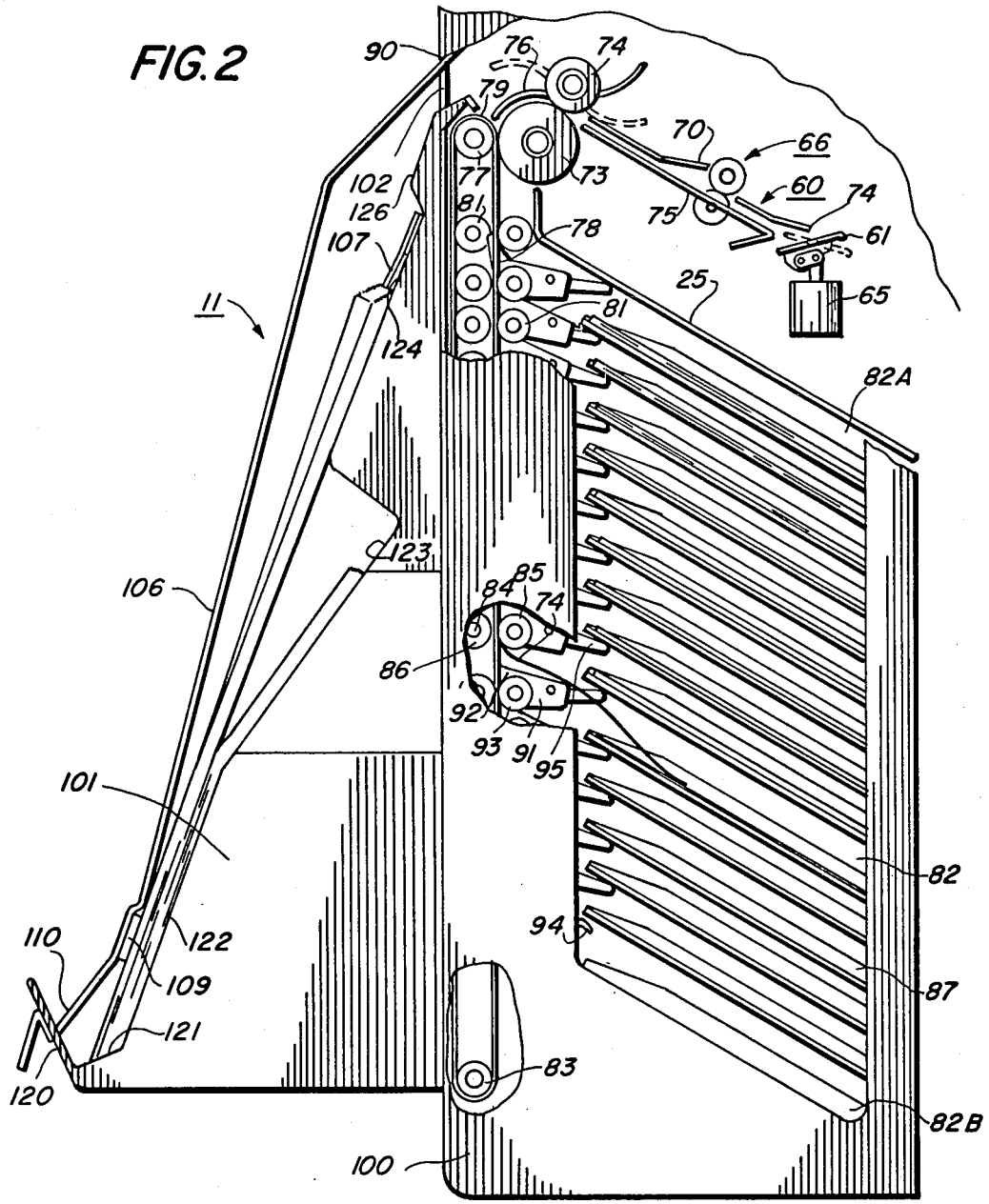
FIG. 2 is an enlarged schematic of the copy catch tray depicting the stacking of copies of two sizes.
Figure 4:
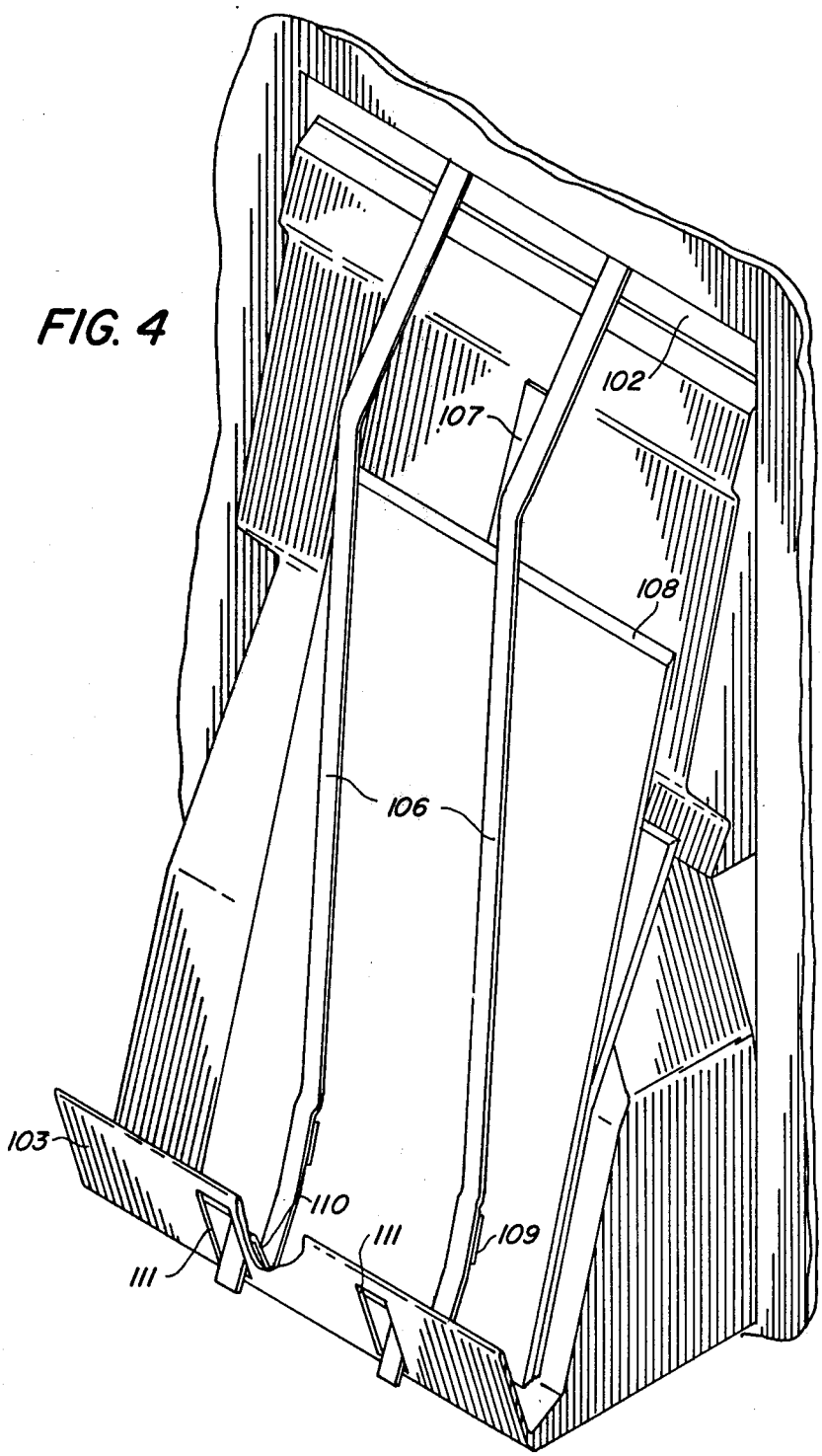
FIG. 4 is a perspective of the external output tray showing the stack restrainer and deceleration member and the corrugating member of the present invention.
Figure 5:
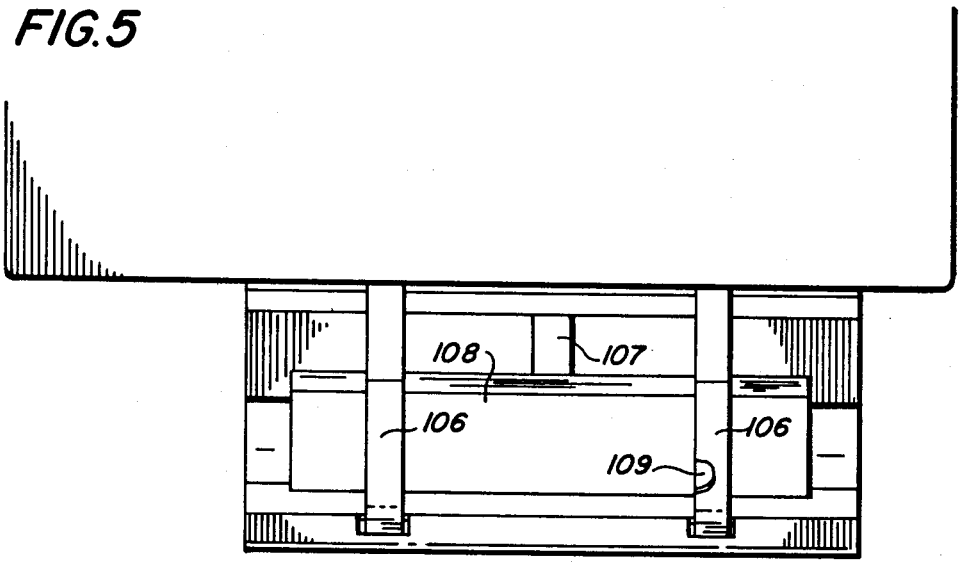
FIG. 5 is a top view of FIG. 4 showing the stack restrainer and corrugating member.

To provide stiffness by increasing the beam strength of the individual copy sheets up to a first size such as letter or legal size a short resilient kicker deflector or corrugating member 107 positioned in the center of the stacking tray under the falling copy sheets urges the sheet to bend longitudinally against the restraining action of the two deflection restraining fingers 106. This may be more completely viewed from FIGS. 4 and 5 where sheet 108 is biased in the center by corrugating member 107 between deflection and restraining fingers 106. Both the deflection and restraining fingers 106 and the corrugating member 107 are elongated resilient members. As shown in FIG. 2 the corrugating member should preferably be capable of being flattened by oversized copies so that they can be neatly stacked. The kicker deflector 107 in addition to giving a stiffness to the copy sheets being stacked also provides a lifting action on the lead edge of the sheet being stacked thereby enabling it to clear the trailing edge of the previously stacked sheet.

While the kicker deflector provides this type of lifting action it should not be so stiff as to adversely interfere with the stacking of oversize copies.

The deflector and restraining fingers have fiber pads at the free or bottom end to further act to decelerate and stack the copy sheets in the tray. These brush pads 109 include fibers that are angled with respect to the direction of movement of the copy sheets so that as the copy sheet engages the fibers it passes easily in the direction in which it is moving because of the inclination of the fibers. However, when the document reaches the end face of the tray and bounces back or attempts to reverse its direction, the frictional resistance between the fibers and the document is increased because of their inclination which causes the documents to stop and stack in a neat pile.

Preferably the coefficient of friction between the copy sheets and the fibers of the pads is approximately about 0.2 or less in the direction in which the sheets are advanced into the output tray. In the reverse direction, however, the frictional forces exerted by the fibers of pads should provide a coefficient of friction greater than about 1.

While any desired material can be employed for the fibrous pads, a material produced by Colln and Aikman, called "Climber" IF-3961 provides excellent results. Alternatively, a Fibertran type material as in the Sanchez, et al patent could be employed.

The material may be installed as a flat type pad as shown in FIGS. 2 and 3 or alternatively it could be applied to a roller at the end of a sheet deflector. An example of a roller at the end of a sheet deflector is found in U.S. Pat. No. 3,709,492 to Baker, et al. The pad shown in the Figures could be easily applied to that roller surface to give the same result.

The restraining and deflecting fingers 106 are preferably resilient so that their cantilever mounting serves to bias the pads downwardly toward the bottom of the tray. The term resilient is intended to indicate that the deflecting and restraining fingers will deform while bearing a load and will resume their original configuration when the load is removed. Thus the functional structural integrety of the fingers is maintained and they may be said to be rigidly resilient.

The cantilever mounting also provides a large opening at the top of the stacking tray thereby minimizing the possibility of stubbing of the individual sheets being stacked. This also enables the restraining and deflecting fingers from moving in and out to accommodate stacks of sheets of varying sizes. The resiliency or spring-like nature of the fingers also provides damping and deceleration of the document to reduce the speed of the document, reduce the bounce when it hits the stop member and stack more effectively. Typically these favorable results are achieved if the normal force between the fiber pads is about 4 grams. If the normal force is smaller, the copy sheet may tend to pass to the bottom of the stop member too readily. On the other hand if the normal force is too great it is possible to stop the paper prior to reaching the bottom of the stop member.

As can be seen in FIG. 3 when the sorter frame 90 is opened the deflecting and restraining fingers are maintained generally in place by the restraining hook 110 and restraining slot 111 arrangement. When the door is closed the resilient deflector and restraining finger are sufficient to deflect the sheets, slow their speed and neatly stacked them in the tray. However once the frame 90 is opened by pivoting it counterclockwise the sheets could fall out of the tray. To prevent this each restraining finger has a restraining hook 110 at the end which when forced counterclockwise by the weight of the stack of sheets is readily inserted in restraining slot 111 in the lip portion 120 of the stacking tray. Therefore as the door 90 is opened the restraining hook and restraining fingers fall into the restraining slot, hooks onto the back of the tray lip portion 120 and holds the copies in place in the tray. While the fastening means has been exemplified by a hook and slot arrangement it should be understood that any suitable fastener means may be used. Typical alternatives includes the use of magnets and other fasteners such as Velcro fasteners which upon contact automatically form the fastening means.

In operation, copies up to a first size may be collected in the lower part of the stacking tray in portions 122 and 123. Alternatively oversize copies up to a second size may be collected using portions 122 and 124. It is also possible to first stack small size copies and then oversize copies. Stacking oversize copies first and then small size copies can present problems because the small size stacking tray is already occupied.

With this additional output capability the reproduction machine readily lends itself to operating in a number of different modes of operation. It is capable of making letter or legal size copies and collecting them in an internal output tray 25 or sorting multiple copies of a multiple page originals into collated sets. It is now also possible to make faithful reproductions of oversize copies and collect them in the external output tray. Thus, in this mode of operation the optical system is fixed and locked into position near the edge of the viewing platen and the document handler feeds the oversized document across the platen P at a speed synchronized with the speed of the drum 12. Additionally, the reproducing apparatus is also capable of operating in a reduction mode whereby copies of reduced magnification from the original are produced. In this mode attention is again directed to FIG. 1 wherein a second lens 114 is depicted which may be substituted in the optical path for the main lens 20 and which may be used to produce copies of varying magnification from the original. With lens 114 in two different positions 114' and 114'', copies of two different magnifications may be produced, depending on the position of lens 114. For further details of how this may be accomplished, attention is directed to U.S. Pat. No. 4,053,221 to Lynch and to U.S. Pat. No 4,033,691 to Bierworth et al.

The control system for operating the reproducing apparatus and in particular the document handler and the sorter described above do not form a part of the present invention and any desired system could be employed as are known in the prior art. For example, any of the various control systems noted in the prior art referenced herein could be adapted to provide the desired control and sequencing signals.

The patents and texts referred to specifically in this application are intended to be incorporated by reference into this application.

In accordance with the invention a copy receiving tray for a multimode reproducing apparatus has been provided. In particular an external copy collecting tray capable of stacking normal and oversized copies in the same tray is provided. A particular advantage is the relative compact size of the stacking device due to the general vertical orientation and the capability because of the tray profile of stacking both regular and oversize copies copies without the stack collapsing. While this invention has been described with reference to the specific embodiments described, it will be apparent to those skilled in the art that many alternatives, modifications or variations may be made by those skilled in the art. For example while a one piece restraining and deflecting finger has been illustrated, that upper and lower portions of the finger could be made from two separate pieces joined by a hinge. Accordingly, it is intended to embrace all such alternatives, modifications as may fall within the spirit and scope of the appended claims.

What is claimed is:

1. Apparatus for stacking sheets comprising a frame, a vertical stacking tray having a stacking face in the sheet receiving position inclined to the horizontal for receiving sheets, said tray having a bottom stop portion and being pivotally mounted at its bottom to the bottom of said frame, whereby on pivoting open the stacking face of the stacking tray is pivoted through the vertical position to a position inclined to the horizontal and reversed in orientation from the sheet receiving position of the stacking tray, means for advancing sheets into said tray, means for decelerating and stacking sheets entering said tray, said decelerating and stacking means comprising at least one resilient elongated member mounted above the sheet advancing means and having a free end at the bottom of said tray, the improvement wherein said free end of said elongated member and said bottom stop portion of said tray have mutually engagable fastening means whereby upon pivoting said tray said fastening means of said resilient elongated member and said fastening means of said bottom stop portion are engaged thereby restraining sheets stacked within said tray from falling out of said tray.

2. The apparatus of claim 1 wherein said fastening means of said resilient elongated member and said fastening means of said bottom stop portion comprise a hook and slot respectively.

3. The apparatus of claim 1 wherein said at least one resilient elongated member has a plurality of fibers supported at a free end of said member, said fibers being inclined in the direction of sheet advancement, said member and said fibers being arranged so that first said member and then said fibers engage said sheets as they advance into said tray whereby said sheets are decelerated and deflected by said member and slide under said fibers in the stacking direction with low frictional resistance until they strike the stop member and said fibers oppose motion of said sheet in a direction opposed to said stacking direction.

4. The apparatus of claim 3 wherein said fibers are inclined forwardly and downwardly of said stacking direction.

5. The apparatus as in claim 3, wherein said resilient elongated member comprises at least one strip type member and further comprises means for cantilever supporting said member at an end thereof opposed to said free end to bias said fibers toward said tray, said cantilever support means being arranged above said sheets as they are advanced into said tray.

6. The apparatus of claim 1 wherein said copy receiving tray comprises a first vertical portion extending from said bottom stop portion in a first vertical direction inclined to the horizontal a distance greater than about ½ the size of a copy sheet having a first size, a second vertical portion inclined further to the horizontal than said first vertical portion out of the path of travel of copy sheets, said second vertical portion extending a distance greater than about ½ the size of a copy sheet having a first size, a third vertical portion above said second portion generally inclined to the vertical in the same plane as said first vertical portion, said third portion providing a stacking support for the top portion of a copy sheet of a size greater than said first size.

7. The copy receiving tray of claim 6 wherein said first, second and third portions comprise planar surfaces.

8. The copy receiving tray of claim 6 wherein said second vertical portion provides stacking support for the top portion of a copy sheet up to said first size.

9. A copy receiving tray of claim 6 wherein said third portion has a resilient kicker deflector strip mounted on its upper portion to assist in giving stiffness to copy sheets as they pass thereover and to lift the leading edge of a sheet being stacked over the trailing edge of a sheet already stacked.

10. The copy receiving tray of claim 6 wherein said first and third vertical portions are inclined from a vertical at an angle greater than about 20°.

11. The copy receiving tray of claim 6 wherein said bottom stop portion comprises a stop portion inclined to the plane of the first vertical portion by a copy sheet change of direction angle of from about 40° to about 50° and a retaining lip at the end of the stop portion inclined to the vertical, said first vertical portion, bottom portion and retaining lip forming a copy sheet catch configuration.

12. The copy receiving tray of claim 11 wherein said retaining lip inclined from said stop portion by a change of direction angle of from about 90° to about 110°.

13. The apparatus of claim 3 wherein the normal force between the fibers on the free end of the elongated member and the stacking tray is about four grams.

* * * * *